US009578933B2

(12) United States Patent
Weller

(10) Patent No.: US 9,578,933 B2
(45) Date of Patent: Feb. 28, 2017

(54) CLOSURE SYSTEM FOR ARTICLES

(71) Applicant: Zipp It GmbH, Vienna (AT)

(72) Inventor: Karl Christian Weller, Vienna (AT)

(73) Assignee: Zipp It GmbH, Vienna (AT)

( * ) Notice: Subject to any disclaimer, the term of this patent is extended or adjusted under 35 U.S.C. 154(b) by 0 days.

(21) Appl. No.: 14/435,493

(22) PCT Filed: Oct. 15, 2013

(86) PCT No.: PCT/AT2013/050203

§ 371 (c)(1),
(2) Date: Apr. 14, 2015

(87) PCT Pub. No.: WO2014/059459

PCT Pub. Date: Apr. 24, 2014

(65) Prior Publication Data

US 2015/0265006 A1 Sep. 24, 2015

(30) Foreign Application Priority Data

Oct. 15, 2012 (AT) ..... A 1115/2012
Jul. 18, 2013 (AT) ..... A 50458/2013

(51) Int. Cl.
*A44B 19/30* (2006.01)
*A44B 13/00* (2006.01)
(Continued)

(52) U.S. Cl.
CPC ..... *A44B 19/301* (2013.01); *A41F 1/02* (2013.01); *A44B 13/0058* (2013.01); *A44B 19/262* (2013.01); *Y10T 24/2513* (2015.01)

(58) Field of Classification Search
CPC . A44B 19/301; A44B 19/262; A44B 13/0058; Y10T 24/2511; Y10T 24/2586; A41F 1/00
See application file for complete search history.

(56) References Cited

U.S. PATENT DOCUMENTS 1,729,489 A 9/1929 Rile
2,111,924 A * 3/1938 Etten ..... A41D 1/06 2/234

(Continued)

FOREIGN PATENT DOCUMENTS

CN 2423774 Y 3/2001
CN 201388614 Y 1/2010

(Continued)

OTHER PUBLICATIONS

Response of Austrian Attorney to European Patent Office in PCT/AT2013/050203, dated Aug. 12, 2014, with an English translation of same.

(Continued)

*Primary Examiner* — Robert J Sandy
*Assistant Examiner* — Rowland Do
(74) *Attorney, Agent, or Firm* — Collard & Roe, P.C.

(57) ABSTRACT

A closure system for an article has a zipper, a slider, as well as a zipper pull tab, in which, in the closed position of the zipper, the zipper pull tab is passed, at least in part, through a closure piece configured or disposed on the article. The slider is held positioned on the article in this closed position. Furthermore, at least in the closed position of the zipper, at least one plate is disposed in the region of the closure piece.

10 Claims, 7 Drawing Sheets

Figure 1:
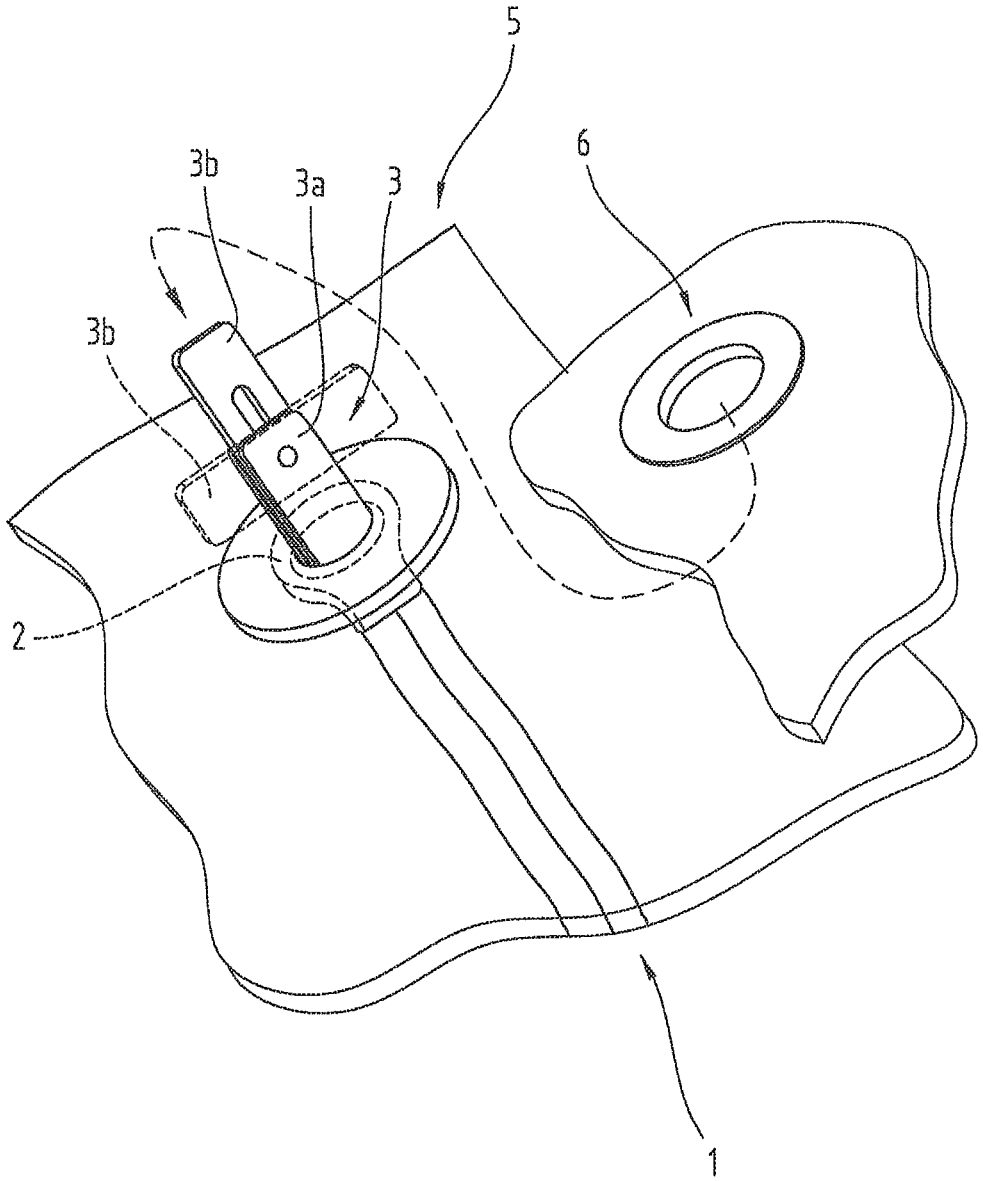

(51) Int. Cl.
*A44B 19/26* (2006.01)
*A41F 1/02* (2006.01)

(56) References Cited

U.S. PATENT DOCUMENTS

| | | | | | |
|---|---|---|---|---|---|
| 2,223,347 | A * | 12/1940 | Axthelm | A44B 19/301 | 24/387 |
| 2,656,579 | A | 10/1953 | Wilson | | |
| 2,675,559 | A * | 4/1954 | Miller | A44B 19/301 | 2/234 |
| 3,255,503 | A | 6/1966 | Sozzi | | |
| 3,271,832 | A | 9/1966 | Yankers | | |
| 3,325,869 | A * | 6/1967 | Younger | A44B 19/301 | 24/387 |
| 4,575,873 | A | 3/1986 | Smith | | |
| 4,580,298 | A * | 4/1986 | Tuisl | A41F 9/025 | 2/220 |
| 4,928,363 | A * | 5/1990 | Easton | A44B 19/301 | 24/370 |
| 5,083,349 | A * | 1/1992 | Axtell | A44B 19/262 | 24/415 |
| 5,263,201 | A | 11/1993 | Hood | | |
| 5,400,480 | A | 3/1995 | Futch, III | | |
| 5,586,368 | A * | 12/1996 | Nelson | A44B 19/301 | 24/370 |
| 7,111,714 | B1 * | 9/2006 | Bell, III | A43B 23/26 | 190/110 |
| 7,200,901 | B2 * | 4/2007 | Pitts | A44B 19/262 | 24/436 |
| 7,971,279 | B2 * | 7/2011 | Abanto | A44B 19/24 | 2/218 |
| 8,533,866 | B1 * | 9/2013 | Lindquist | A44B 1/18 | 2/96 |
| 8,533,918 | B1 * | 9/2013 | Ketter | A44B 19/285 | 2/218 |
| 9,232,835 | B2 * | 1/2016 | Kearl | A44B 19/301 | |
| 2007/0289110 | A1 * | 12/2007 | Bekeschus | A44B 19/262 | 24/436 |
| 2009/0276984 | A1 | 11/2009 | Rabe | | |
| 2012/0017402 | A1 * | 1/2012 | Feinberg | A44B 19/301 | 24/387 |

FOREIGN PATENT DOCUMENTS

| | | | |
|---|---|---|---|
| CN | 201691194 | U | 1/2011 |
| CN | 201860831 | U | 6/2011 |
| CN | 202445259 | U | 9/2012 |
| DE | 102 40 715 | A1 | 7/2003 |
| DE | 10 2008 041 781 | A1 | 3/2010 |
| EP | 2394526 | A1 | 12/2011 |
| GB | 411 459 | A | 6/1934 |
| GB | 1 144 678 | A | 3/1969 |
| JP | H03 85911 | U | 8/1991 |
| JP | 2010 057689 | A | 3/2010 |
| WO | 94/12064 | A1 | 6/1994 |
| WO | 2012/012707 | A1 | 1/2012 |

OTHER PUBLICATIONS

International Search Report of PCT/AT2013/050203, mailed Feb. 3, 2014.

* cited by examiner

CLOSURE SYSTEM FOR ARTICLES

CROSS REFERENCE TO RELATED APPLICATIONS

This application is the National Stage of PCT/AT2013/050203 filed on Oct. 15, 2013, which claims priority under 35 U.S.C. §119 of Austrian Application Nos. A 1115/2012 filed on Oct. 15, 2012 and A 50458/2013 filed on Jul. 18, 2013, the disclosures of which are incorporated by reference. The international application under PCT article 21(2) was not published in English.

The invention relates to a closure system having a zipper, a slider, as well as a zipper pull tab.

From U.S. Pat. No. 5,263,201 A and its parallel WO 94/12064 A, a closure system for an article of clothing has become known, which comprises a zipper, a slider, as well as a zipper pull tab configured in the form of a button. In the closed position of the zipper, the zipper pull tab is passed, at least in part, through a closure piece configured on the article. In this way, the slider is held in the closed position of the zipper, positioned on the article.

Similar closure systems, in which the slider of the zipper is held on a closure part configured on the article with its zipper pull tab, are described, for example, in CN 202445259 U, CN 201691194 U, CN 201860831 U, U.S. Pat. No. 5,400,480 A, GB 1,144,678 A, DE 102 40 715 A1, as well as JP 2010 057689 A, U.S. Pat. No. 3,271,832 A, and JP H03 85911 U.

For example, in JI 2010 057689 A a zipper system for a storage container is disclosed, which comprises a zipper, a slider, and a zipper pull tab configured as a pin. In a closed position of the zipper, the pin can be passed through a pass-through opening of a slide-prevention element disposed on the interior of the container. In this connection, the slide-prevention element and the pass-through opening are disposed close to an interior wall of the storage container. When the pin is passed through the pass-through opening, opening of the zipper is prevented in that the pin pivots against an interior wall of the storage container during an opening procedure of the zipper or of the slider, and a lower end of the pin lies against the interior wall, transferring the load to the interior wall of the storage container.

U.S. Pat. No. 3,271,832 A discloses an article of clothing, such as, for example, a pair of pants or the like, having a zipper system disposed on the fly. The zipper system has a slider and a zipper pull tab connected with the slider. In this connection, the zipper pull tab is configured in such a manner that it can be locked in place or hooked onto an eye configured on an inner tab of the waistband. In addition, a hook is configured on the inside of the tab of the outer waistband, facing the inner waistband, which hook interacts with the eye on the inner waistband of the pants to close the fly.

In JP H03 85911 U, a suitcase or similar article of storage or transport is shown, which can be closed by means of a zipper system. The zipper has two sliders, by means of which the suitcase can be closed by displacing them in opposite directions. To lock the suitcase, a numerical combination lock is disposed on the suitcase. Zipper pull tabs are disposed on the two sliders, in each instance, wherein an eye is configured on a first zipper pull tab. An opening is configured on the other zipper pull tab, through which the eye of the first zipper pull tab can be passed. In the interior of the numerical combination lock, a pin is disposed to lock the eye of the first zipper pull tab. The suitcase can be locked in that the eye of the first zipper pull tab is passed through the opening of the other zipper pull tab and locked in place by means of the pin of the numerical combination lock, so that both zipper pull tabs are held by the numerical combination lock.

From GB 411 459 A, a closure system for an article of clothing has become known, in which the zipper can be closed with a slider. A zipper pull tab is disposed on the slider, in which an element of the zipper pull tab is mounted so as to pivot, so that it pivots on that element of the zipper pull tab that is connected with the slider. In this way, the relative position or location of the pivoting element with regard to the slider can be changed.

Closures for articles of clothing, for example for pants or skirts, have become known in the most varied forms. In most cases, the articles of clothing are closed either with buttons of any type or with zippers in combination with buttons and a related opening in the article of clothing (buttonhole).

By means of providing the closure system, it is possible to do without the provision of buttons, closers or buckles for additional securing of articles of clothing. The articles of clothing are exclusively held together and attached by means of a zipper and the slider plus zipper pull tab (zipper pull) connected with it. In this way, on the one hand it is possible to do without the additional placement of buttons, and, at the same time, the phenomenon of open zippers when clothes are worn is avoided. This contributes to avoiding embarrassing awkwardness of this type.

The present invention is based on the task of creating a closure system that, in addition to its securing to prevent unintentional opening of the zipper, can be easily and individually adapted to different purposes of use or wearing conditions, even by the user, in order to make a high level of configuration options available to the user.

This task is accomplished by the characteristics according to the invention. The advantage that results lies in that in this way, after the closure has been secured and the slider has been held in place over the zipper pull tab, a plate-shaped body can be disposed on the closure piece of the article, on the side of the article facing away from the slider. In this way, for example, affixation and also individual configuration of the closure system can be made possible for the user, in simple manner, using a simple connection process. By means of providing the plate, however, additional securing of the zipper pull tab in its locked position can be achieved in the region of the closure piece. However, beyond this, covering or shielding of the closure system in the region of the closure piece can be achieved. By means of the use of the most varied engagement systems, a simple possibility of changing the plate, depending on the case of use or purpose of use, can be made possible, thereby making it possible to select one or more correspondingly configured plates, in order to thereby change the individual appearance of the closure system and adapt it to the desires of the user, in simple manner. Thus, it would be possible, for example, to be able to individually adapt the color, the shape, as well as the design and the optical appearance of the plate to other clothing accessories, such as, for example, a belt, glasses, a handbag, shoes or the like. By means of the configuration of a base part, it is possible to make a further configuration possibility available, wherein because of the placement of the plate directly on the closure piece, the plate no longer needs to be taken off the closure piece to open the closure system. In this case of use, an optically appealing appearance can be achieved, because the plate projects beyond the base part, at least radially, and thereby can be disposed very close to the surface of the article. In the axial direction, viewed with reference to the base part, the plate is dimensioned in such a manner that it preferably ends approximately flush with the base part on the side facing away from the slider or also projects slightly beyond the end in the axial direction. In the case of a planar or set-back placement of the plate, the latter can be protected from damage proceeding from the zipper pull tab. In this way, direct contact of the zipper pull tab with the plate, in its locked position, can be avoided.

By means of the configuration of the plate as an application element, the result is achieved that in this way, a high level of configuration possibilities for the user and thereby individual adaptation to the user's needs is created.

A further embodiment is also advantageous, because in this way, by means of connecting or holding the plate on the zipper pull tab, the latter can be additionally secured to prevent unintentional opening. Furthermore, however, improved optics are also created, because no direct visual contact with the closure system, particularly the closure piece, is made possible. Furthermore, however, in this way the risk of injury can also be reduced.

Furthermore, another embodiment is advantageous, because in this way, an even greater configuration possibility for the most varied cases of use is created. In this way, even more configuration possibilities can be created, because thereby the combination variety can be further increased. Thus, a modular system can be created, which allows the user to be able to combine not only the plate configured as a support plate, but also a great number of different application elements with it.

A further development is also advantageous, because in this way, the possibility is created of applying even application elements that would otherwise be easily damaged to the base part and holding them there. Thus, the support apparatus can also be referred to as a setting or bezel, as is frequently the case in the jewelry industry, in the case of stories or precious stones.

In another embodiment, it is advantageous that in this way, in a case of use or in use, secured mounting of the application element, if necessary with the interposition of the support apparatus, on the base part of the closure piece can be achieved. Furthermore, however, in this way tool-free replacement of the application element or of the plate can be carried out by the user or user.

By means of a further development , the result is achieved that in this way, the engagement element can be configured on the base part right away during its production and in one work step. This engagement element can be configured as a bead or thickened region, and thereby an additional optical configuration possibility is already made possible on the base part in this region, too.

By means of another embodiment, even sensitive application elements or those at risk of breakage can be used, because the support apparatus performs a certain support and/or holding function for such components.

Another embodiment is also advantageous, because in this way a dual function can be performed by the holding element(s) of the support apparatus. In this way, the holding element serves not only for positioning or fixation of the application element on the support apparatus, but rather, in interaction with the first engagement element disposed on the base part, forms the engagement apparatus for the application element attached to the support apparatus.

According to another embodiment, a further engagement position between the application element or its support apparatus and the base part of the closure piece can be achieved. Depending on the axial length of the base part, in this way distancing of the base plate, which is configured in the shape of a disk, from the side of the article facing away from the zipper can be achieved. In this way, because of this distancing between the base plate and the article, at least one further plate or one further application element can be disposed on the base part, wherein the engagement or holding can take place by means of the support apparatus.

In this connection, another embodiment proves to be advantageous, because in this way, the application element or the support apparatus is impacted with a setting force on the side of the article facing away from the zipper, thereby pressing the slider against the side of the article facing the zipper when the zipper pull tab makes contact with the application element. By means of this bias, unintentional loosening of the zipper pull tab in its locked position is additionally prevented.

However, another embodiment would also be possible, because in this way, a cost-advantageous attachment possibility to the article is created by way of a simple connection process, as it is already used in known rivet connections.

Finally, however, another embodiment is also possible, because in this way, the closure system can be protected against unauthorized opening.

For a better understanding of the invention, it will be described in greater detail using the following figures.

Figure 2:
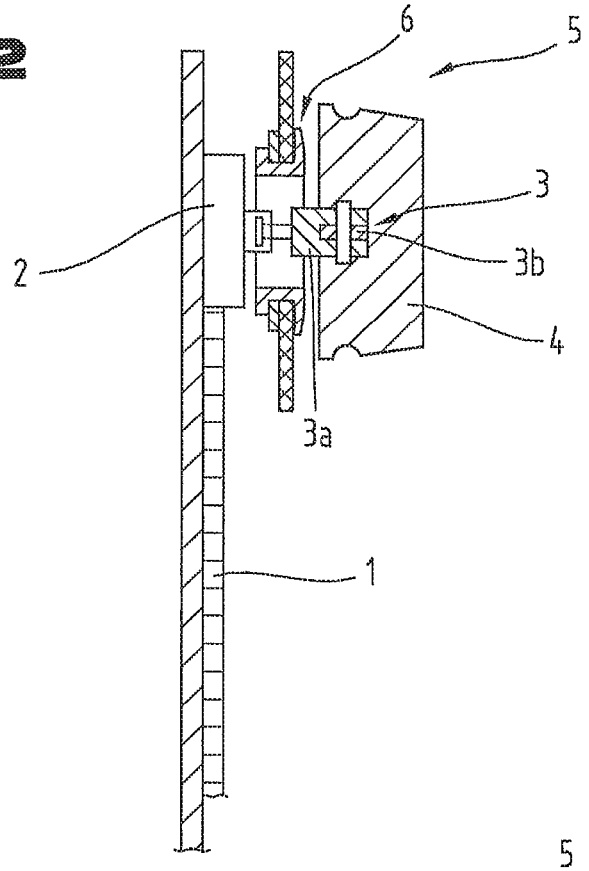
Figure 3:
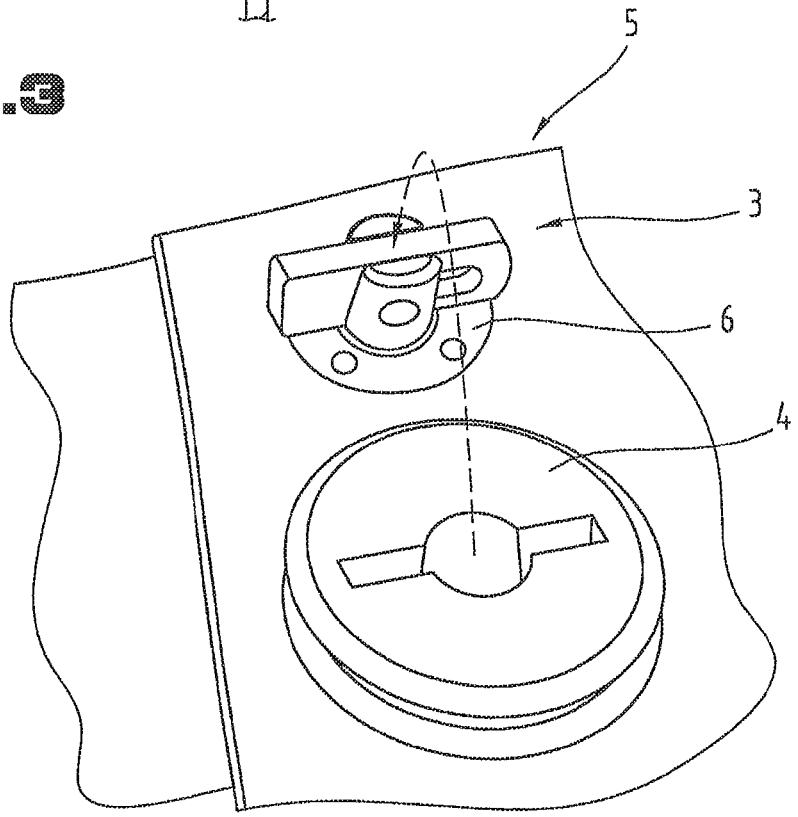
Figure 4:
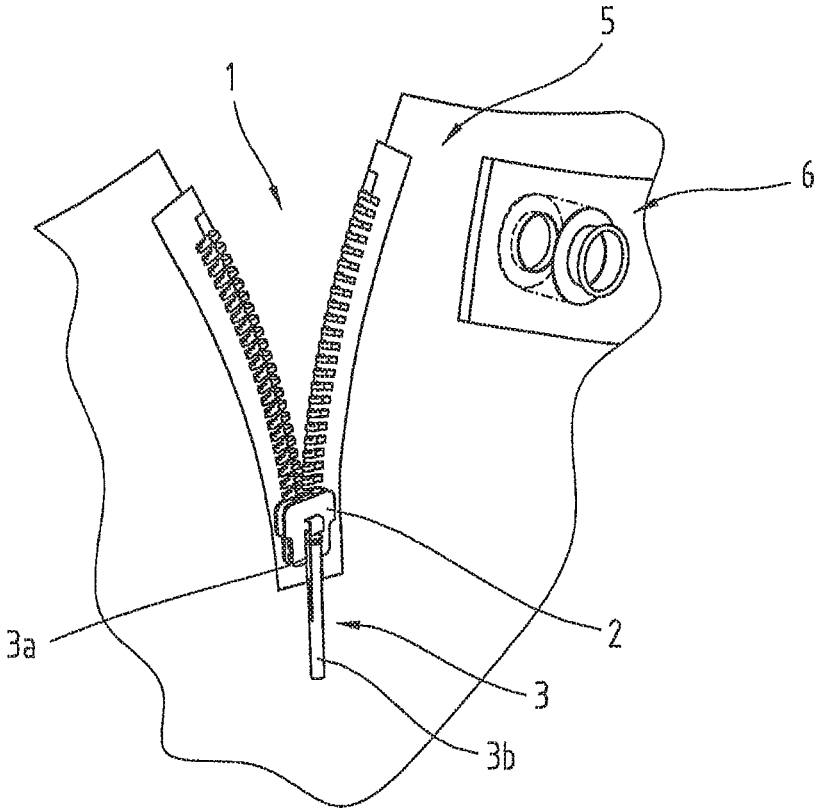
Figure 5:
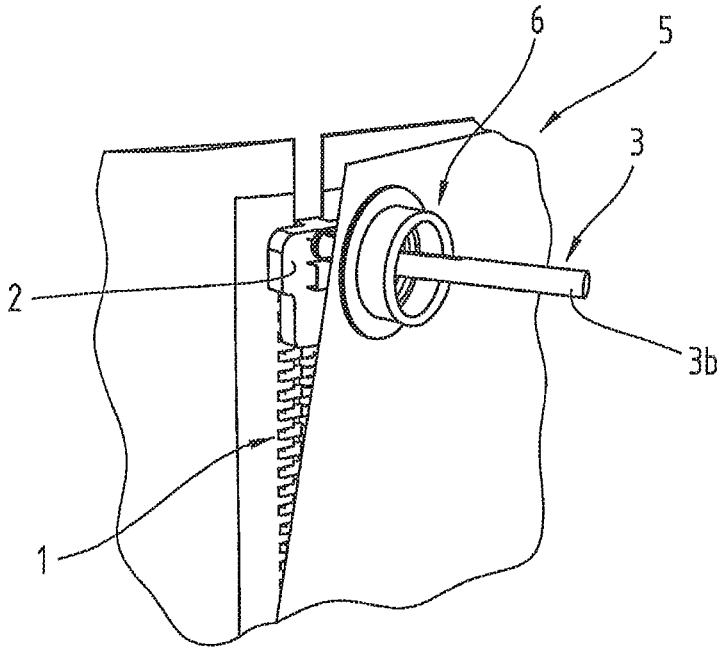
Figure 6:
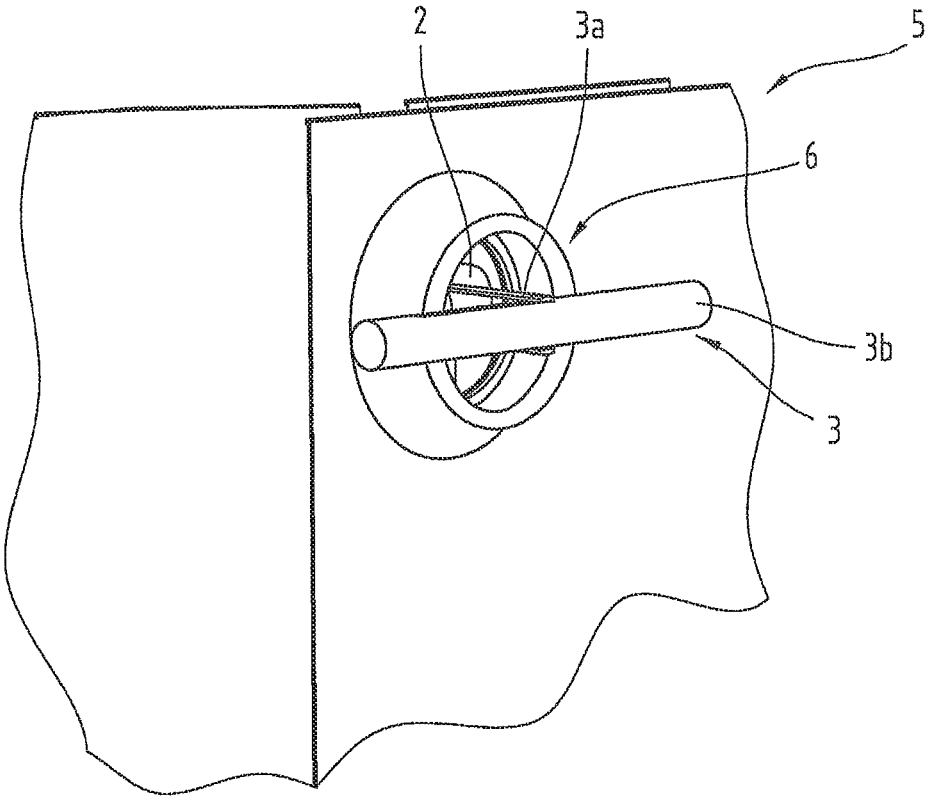
Figure 7:
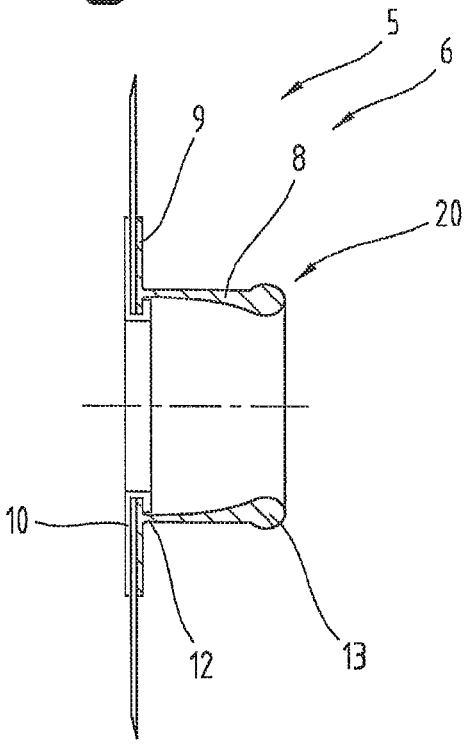
Figure 8:
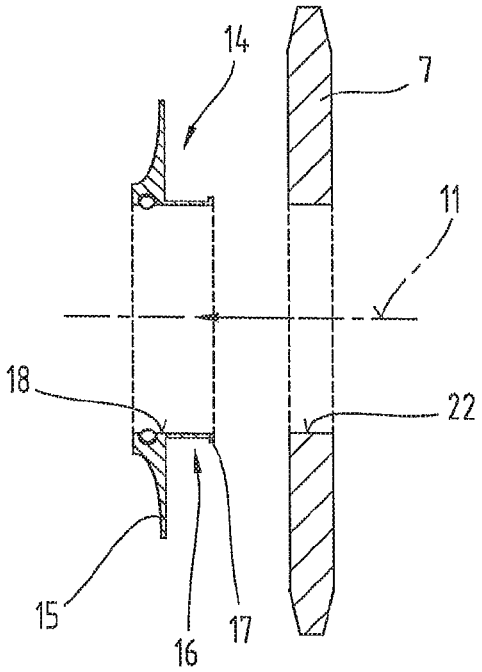
Figure 9:
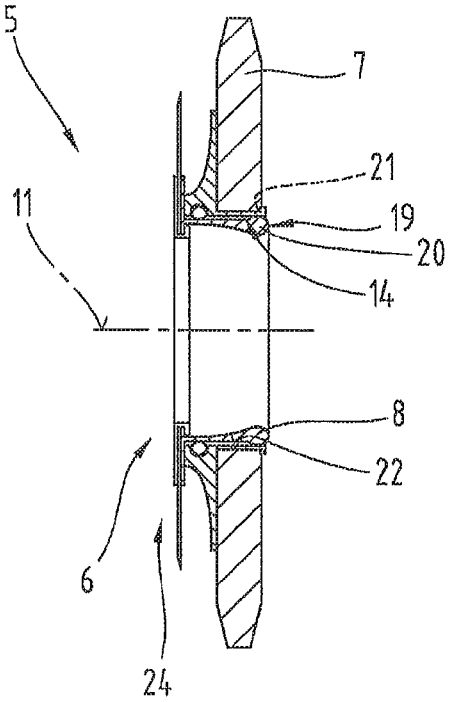
Figure 10:
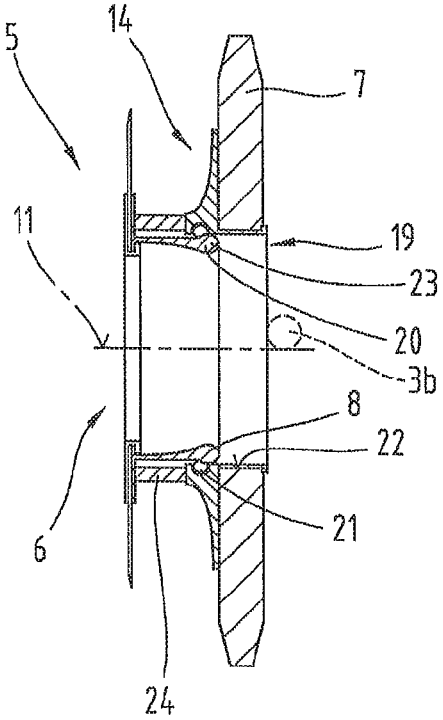
Figure 11:
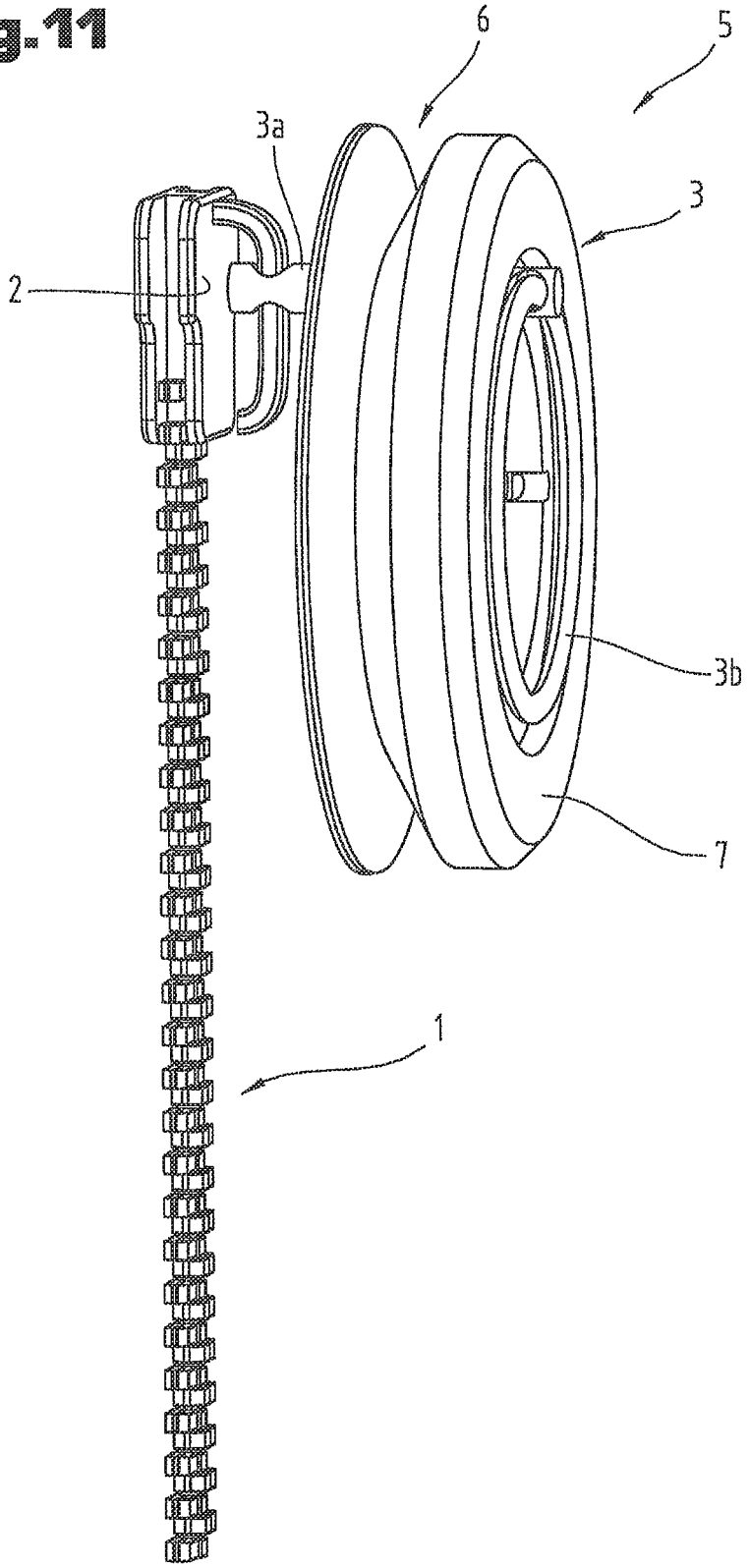
Figure 12:
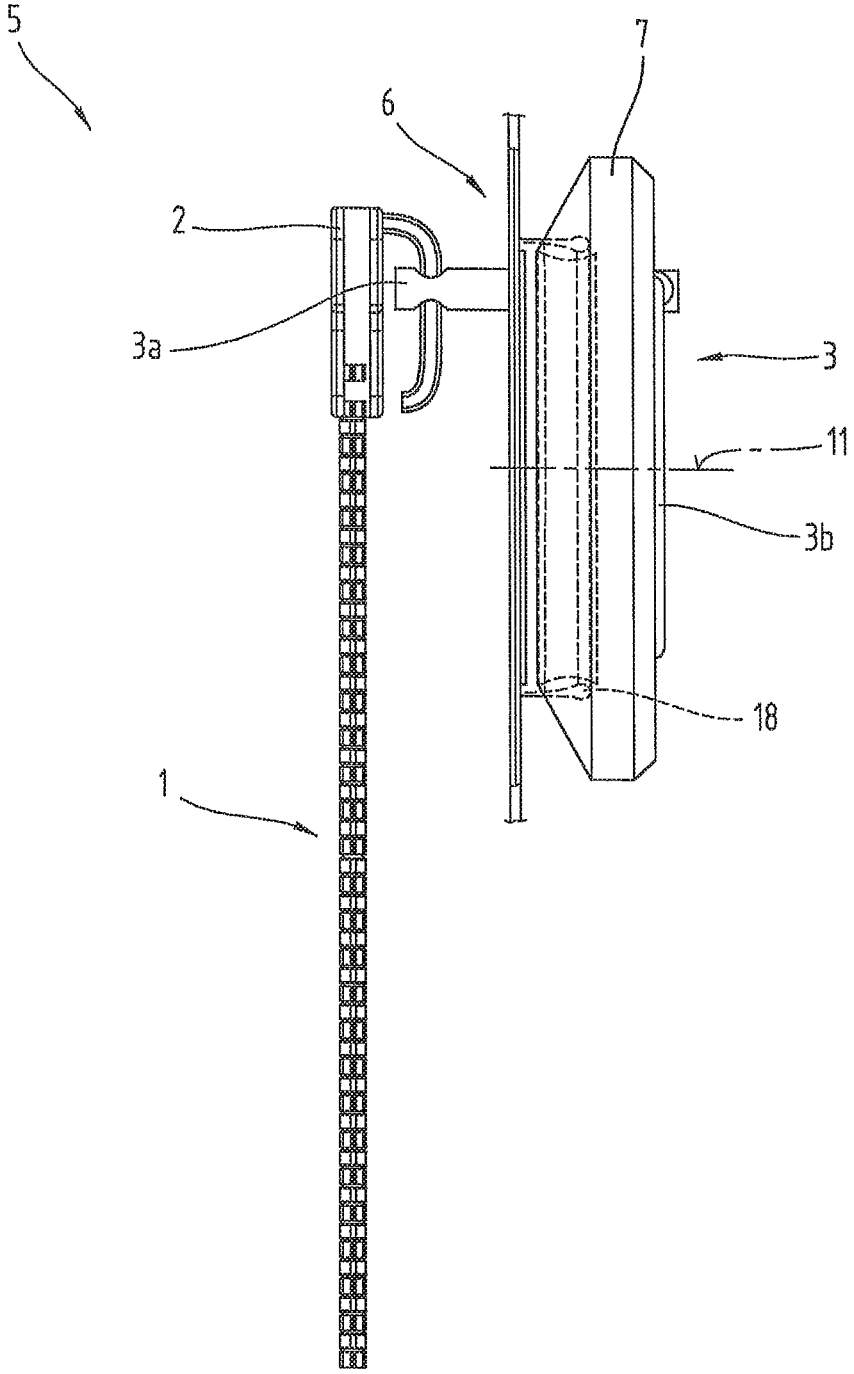

These show, each in a greatly simplified, schematic representation:

FIG. 1 a possible embodiment of a closure system, in a diagrammatic representation;

FIG. 2 a further closure system having a plate additionally disposed in the region of the closure piece, in a side view, in section;

FIG. 3 the closure system according to FIG. 2 before the plate is put into place, in a diagrammatic representation;

FIG. 4 another possible embodiment of a closure system, with the zipper still open, in a diagrammatic representation;

FIG. 5 the closure system according to FIG. 4, during the closing process, in a diagrammatic representation;

FIG. 6 the closure system according to FIGS. 4 and 5 in the closed position, in a diagrammatic representation;

FIG. 7 a closure piece affixed to the article, in a side view, in section;

FIG. 8 an application element as well as a support apparatus before their joining process, in a side view, in section;

FIG. 9 the application element according to FIGS. 7 and 8, held on the closure piece by means of the support apparatus, in a side view, in section;

FIG. 10 a further possible embodiment of an application element as well as of a support apparatus, with a spring element disposed between them, in a side view, in section;

FIG. 11 a further possible closure system with closure piece and engaged zipper pull tab, in a diagrammatic representation;

FIG. 12 the closure system according to FIG. 11, in a side view, in section.

As an introduction, it should be stated that in the different embodiments described, the same parts are provided with the same reference symbols or the same component designations, wherein the disclosures contained in the entire description can be transferred analogously to the same parts having the same reference symbols or the same component designations. Also, the position information chosen in the description, such as, for example, at the top, at the bottom, at the side, etc., refer to the figure being directly described and shown, and this position information must be transferred analogously to a new position when a change in position occurs.

In FIGS. 1 to 3, a first embodiment of a closure system 5 is shown, which can fundamentally be used for the most varied articles. In the present exemplary embodiment, the closure system 5 is shown in an application for an article of clothing.

The article of clothing is closed by means of a zipper 1, the slider 2 of which serves as a support of the closure system 5, by means of which the article of clothing is held together and fastened. The zipper pull tab 3 attached to the slider 2 takes on the button function, in that it is passed through an opening created on the article of clothing to be closed, for example a buttonhole or an eye, and brought down. The zipper pull tab 3 consists of two elements 3*a*, 3*b* that are connected with one another and can be set at an angle of 90° relative to one another and fixed in place. In this way, the article of clothing or the eye is held in place as by a button, and cannot be loosened without an intentionally performed mechanical effort.

The slider 2 is adapted, in terms of its function and its size, in such a manner that in addition to its original function, it additionally serves as a support of the zipper pull tab 3, which consists of two elements 3*a*, 3*b* that are connected with one another and can be set relative to one another by an angle of up to 90° and, if necessary, beyond that, and fixed in place. The slider 2 or closer is configured, in terms of its size, in such a manner that it serves as a counter-piece and hold for the closure piece 6, for example an eye or a bordered buttonhole. The two-part zipper pull tab 3, after having been passed through the opening of the article of clothing to be closed, is brought down at an angle of up to 90° and, if necessary, beyond that, and locked in place. Locking takes place by means of a mechanically produced resistance, for example using a resistance produced by a spring, by means of an engagement system, using a ball biased by a spring, or by means of other closure mechanisms and engagement systems, or by means of pressure exerted by the body of the wearer of the clothing.

The slider 2 or closer is configured in such a manner that it helps to take on the handle function, in part, and is connected with a zipper pull tab 3, in such a manner that part of the slider 2 is passed through the opening of the article of clothing to be closed, with the zipper pull tab 3, and the zipper pull tab 3, as the single element, connected with the slider 2, is furthermore brought down at an angle of up to 90° and, if necessary, beyond that, and locked in place. By means of this movement and locking, the slider 2 is held positioned on the article in this closed position of the zipper 1.

In addition, the zipper pull tab 3 can be secured, in the closed state, by means of a plate 4, which can simultaneously serve as a support plate for affixing various decorative objects, for example artistic decorations, motifs, three-dimensional designs, stones. These can be individually attached to the support plate as clothing accessories. The clothing accessory can also be referred to as an application element 7, as is the case in the following description.

In this way, at least in the closed position of the zipper 1, at least one plate 4 is disposed in the region of the closure piece 6. This plate 4 itself can either be configured as an accessory or application element 7, or can serve as a support plate for attaching accessories or application elements 7. The application element 7 or the plate 4 can furthermore be made from the most varied materials, such as, for example, metal, glass, ceramics, plastic, sintered materials, stone, precious stone, as well as any desired combination of them. Also, the spatial shape and the appearance can be freely selected.

Thus, in the closed state, the zipper pull tab 3 is secured by means of the plate 4, which is set onto the zipper pull tab 3. By means of the set-on plate 4, the zipper pull tab 3 is prevented from coming loose out of the lock. The plate 4 is attached and secured to the zipper pull tab 3, for example by means of a spring mechanism, ball bearing, closure mechanisms, engagement systems, and the like.

Furthermore, the slider 2 and the zipper pull tab 3 can be secured, in the closed state, by means of the plate 4, which is set onto part of the slider 2 and the zipper pull tab 3.

Because the zipper pull tab (3), in the closed state, is connected with the counter-piece (by being passed through the buttonhole or eye) of the article of clothing, the possibility is excluded that the zipper (1) can open, in undesired manner, while wearing it, because the upper end of the closed zipper (1) is fixed in place on the article of clothing.

It should be noted here that use is not restricted to zippers 1 in the clothing sector, but is also used for industrially utilized closure systems that use a zipper.

In the production of articles of clothing, such as, for example, pants and skirts, it is possible to eliminate a production process such as affixing buttons or other closure mechanisms, and this contributes to savings in production and to avoiding errors in the production process.

The article can particularly be articles of clothing, handbags, suitcases, coverings, covers, tarps, mattress covers or the like.

In FIGS. 4 to 6, a further embodiment of the closure system 5, which can be independent, if applicable, is shown, wherein once again, the same reference symbols or component designations as in the preceding FIGS. 1 to 3 are used for the same parts. In order to avoid unnecessary repetition, the detailed description regarding the preceding FIGS. 1 to 3 is pointed out and referred to.

The closure system 5 shown here comprises, also in the case of this exemplary embodiment, once again the zipper 1, the slider 2, as well as the zipper pull tab 3 with its two elements 3*a*, 3*b*, as well as the closure piece 6. The zipper 1 can also, once again, be disposed on an article of clothing shown in simplified form, wherein the closure piece 6 is disposed positioned in a partial region or partial section of the article of clothing, for example in the form of an eye. The closing process takes place analogously here, as has already been described in detail above, in FIGS. 1 to 3.

First the zipper 1 is closed, by way of the slider 2, in known manner, wherein activation takes place by means of the zipper pull tab 3. After the zipper elements have been connected by the slider 2, the zipper pull tab 3 is passed through the opening formed by the closure piece 6, and for locking, the second element 3*b* is pivoted relative to the first element 3*a*, into a position at an angle to it. Because the longitudinal expanse of the second or further element 3*b* is selected to be longer or greater than the opening diameter of the closure piece 6, locking of the zipper pull tab 3 with the closure piece 6 takes place here. Because the zipper pull tab 3 is connected with the slider 2 in this manner, here too, once again, unintentional loosening or opening of the zipper 1 can be prevented.

In FIGS. 7 to 9, a further embodiment of the closure system 5, which can be independent, if applicable, is shown, wherein once again, the same reference symbols or component designations as in the preceding FIGS. 1 to 6 are used for the same parts. In order to avoid unnecessary repetition, the detailed description relating to the preceding FIGS. 1 to 6 is pointed out or referred to.

Thus, in FIG. 7, the closure piece 6 disposed on the article, particularly the article of clothing, is shown in axial section. Here, the closure piece 6 comprises a base part 8 configured in the form of a hollow profile or a tube, which in turn is connected with the article. This generally takes place in a locally fixed arrangement, in order to achieve a correspondingly firm, stable seat. Furthermore, the base part 8 can have a ring flange 9 on its side facing the article, which flange has a contact surface for support on the article, which surface is configured in planar manner. The base part 8 can be connected, by way of the ring flange 9, with a ring 10, for example in the form of a riveting process, in order to thereby configure the closure piece 6. The riveting process and the components used during it to form the grommet, can be selected and used as desired from the known state of the art.

The base part 8 generally has a circular cross-sectional shape, wherein diameter differences in the direction of its longitudinal axis 11 are possible.

The base part 8, seen in the direction of the longitudinal axis 11, has a first end 12 that faces the article or the ring flange 9, as well as a further end 13 that is spaced apart from that. The base part 8, as well as, if applicable, the ring flange 9 are disposed on the side of the article facing away from the zipper 1, wherein the further or second end 13 of the base part 8 is configured to project out of the side facing away from the zipper 1.

Furthermore, it is possible that the plate 4 described above is disposed on or connected with the base part 8. This attachment or hold preferably takes place on the outside, on the side of the base part 8 facing away from the longitudinal axis. If the plate 4 is configured as an application element 7, particularly as a decorative object, artistic decoration, motif, stone or clothing accessory, in this way direct accommodation and holding of the plate 4 on the base part 8 can take place.

In FIGS. 8 and 9, it is now shown that it is also possible to dispose or hold the application element 7 on a separate support apparatus 14. Thus, it becomes possible to attach the application element 7 to the base part 8 by means of the support apparatus 14.

In the exemplary embodiment shown here, the support apparatus 14 for the application element 7 comprises a base plate 14 configured in disk shape, as well as at least one holding element 16 that is connected with it and extends in the perpendicular direction with reference to the base plate 15. Preferably, the holding element(s) 16 is/are oriented in the axial direction with reference to the inner opening of the base plate 15. By means of the holding element 16, the application element(s) 7 can be attached to or held on the support apparatus 14.

Independent of this, however, it would also be possible to use only the base plate 15, which is configured in disk shape, and to connect the application element(s) 7 with one another by way of a material-fit connection, such as an adhesive connection or the like, for example.

The holding element 16 can preferably be configured as a wall part that runs continuously over the circumference, in tubular shape, wherein additionally, a collar 17 or multiple collar elements can be provided on the side facing away from the base plate 15. However, it would also be possible to provide only holding elements 16 disposed distributed over the circumference instead of the circumferential wall part, by means of which elements the application element 7 can be attached to or held on the support apparatus 14, particularly the base plate 15.

The holding element(s) 16 is/are disposed in the region of the base plate 15, in the region of the opening 18 that passes through the base plate 15.

The assembled position of the application element 7 with the support apparatus 14 can be seen in FIG. 9. In addition to this, the closure piece 6 is also shown, as it has already been described in detail above in FIG. 7.

As is now evident from this engaged position of FIG. 9, an engagement apparatus 19 is provided between the support apparatus 14 and the base part 8. In the present exemplary embodiment, a first engagement element 20 is disposed or configured on the base part 8. A second engagement element 21 is disposed or configured on the support apparatus 14, particularly the holding element 16. In this way, the support apparatus 14 and, consequently, the application element 7 can be held positioned in at least one direction oriented in the axial direction of the base part 8.

If the application element 7 were disposed on the base part 8 by itself and without the support apparatus 14, then the second engagement element 21 is disposed or configured on the application element 7. This is illustrated with the reference number 21 entered with broken lines at the application element 7.

The application element 7 also has an opening 22 in its center, which is configured in such a manner that it can be either set directly from the outside onto the holding element 16 or attached to or held on the base part 8 without the interposition of the support apparatus 14.

Thereby the first engagement element 20 is disposed or configured on the base part 8 at an end of the latter facing away from the closer 2. The at least second engagement element 21 of the engagement apparatus 19 is disposed or configured on the support apparatus 14 at an end of the holding element 16 facing away from the slider 2.

In FIG. 10, a further embodiment of the closure system 5 is shown, which can also be independent, if applicable, wherein once again, the same reference symbols or component designations as in the preceding FIGS. 1 to 9 are used for the same parts. In order to avoid unnecessary repetition, the detailed description relating to the preceding FIGS. 1 to 9 is pointed out or referred to.

This embodiment variant shown here is configured in similar manner as has already been described above in FIGS. 7 to 9, particularly FIG. 9. In contrast to this, here the at least second engagement element 21 of the engagement apparatus 19 is disposed or configured on an inside surface 23 of the base plate 15, which plate is configured in disk shape. Thus, this second engagement element 21 can either be formed by a separate component that is disposed on the inside surface 23 in the form of a securing ring or the like, or can be part of the base plate 15.

Furthermore, in FIG. 10 it is also shown that the support apparatus 14, with the application element 7 disposed on it, has a setting force built up by a spring element 24 applied to it in the axial direction with reference to the base part 8, on the side facing away from the slider 2.

If no support apparatus 14 is provided, however, independent of this the application element 7 can have a corresponding setting force applied to it solely by means of the spring element 24, on the side of the base part 8 facing away from the slider 2. By means of the spring element 24, the result is achieved that the support apparatus 14 or the application element 7 is pressed solely against the pivoted element **3*b* of the zipper pull tab 3 described above. In this way, a tensioned or biased position of the zipper pull tab 3 in the closed position of the zipper 1** is always achieved.

The closure piece 6 shown in FIGS. 7 to 10 forms an eye with the ring flange 9, for example, wherein the base part 8, if applicable with the interposition of the ring flange 9, forms a structural unit with the ring 10. This can also be referred to as a grommet or a ring eyelet.

In FIGS. 11 and 12, a further embodiment of the closure system 5 is shown, which can also be independent, if applicable, wherein once again, the same reference symbols or component designations as in the preceding FIGS. 1 to 10 are used for the same parts. In order to avoid unnecessary repetition, the detailed description relating to the preceding FIGS. 1 to 10 is pointed out or referred to.

Here, too, a further closure system 5 is shown, which comprises the zipper 1, the slider 2, as well as the zipper pull tab 3. The element 3*a* of the zipper pull tab 3, which is connected with the slider 2, is configured in rod shape and projects through the closure piece 6, which is disposed fixed in place on the article, if applicable, as has already been described above.

Furthermore, in this exemplary embodiment it is shown that the application element 7 is disposed or held directly on the closure piece 6, without the interposition of the support apparatus 14. The cross-sectional shape of the application element 7 can be selected in any desired manner, wherein here again, as in the exemplary embodiments described above, a change or replacement of the application elements 7 on the closure piece 6 is possible by the user himself/herself. This is achieved by means of the engagement apparatus 19 described above.

Here the zipper pull tab 3 comprises, in addition to the first element 3*a* configured in rod shape, which is connected to move with the slider 2, the further element 3*b*, which is configured as a preferably ring-shaped or partially ring-shaped body. The further element 3*b* is connected with the first element 3*a* on its side facing away from the slider 2, in articulated or pivoting manner. In this exemplary embodiment, it is advantageous if the element 3*b* is flexible and therefore formable in terms of its spatial shape. In this way, passing the element 3*b* through the closure piece 6 can be facilitated, because the ring can thereby be brought into a slightly oval shape. After having been passed through the inner opening of the closure piece 6, the flexibly configured element 3*b* can automatically return to its original starting shape. Thus, a certain holding effect can be brought about in this original spatial shape, and, connected with this, unintentional opening of the zipper 1 can be prevented. The flexible formability of the element 3*b* can, however, also serve to lock the element in place on or in the closure piece 6, particularly its base part 8.

In this way, it becomes possible for the closure process of the article to position the closure piece 6, if applicable with the application elements 7 disposed or held on it, after the zipper 1 has been closed, in such a manner that the zipper pull tab 3 with its further element 3*b* can be passed through the inner opening of the closure piece 6. In this connection, the first element 3*a* of the zipper pull tab 3 is also passed through the closure piece 6, at least in part. After this closure process and the related holding of the slider 2 relative to the closure piece 6, the further element 3*b* can be brought into an approximately right-angle position with regard to the longitudinal axis 11 of the base part 8 of the closure piece 6. During the course of this turning down of the further element 3*b*, this element can additionally be held engaged also on the support apparatus 14 and/or the application element 7.

However, a combination of the embodiment according to FIGS. 2 and 3 with the embodiments of FIGS. 7 to 10 would also be conceivable. In this way, multiple application elements 7 can be disposed and held position in different positions relative to one another in the region of the closure piece 6.

Furthermore, however, it would also be possible that the plate 4 and/or the application element 7 and/or the support apparatus 14 for the application element 7 forms/form a closing device or locking device in interaction with the closure piece 6 as well as at least one locking element. In this way, the result can be achieved, by providing one or more locking elements, that the zipper 1 can be additionally locked, secured to prevent unauthorized opening. This would be a possible further task of the invention, namely developing the closure system 5 with the zipper 1, the slider 2, as well as the zipper pull tab 3 further, in the region of the closure piece 6, in such a manner that opening the locking apparatus is made possible only for an authorized person. This would be an area of used in the case of mattress covers in the prison sector, for example, in the case of car and truck tarps or the like.

The exemplary embodiments show possible embodiment variants of the closure system 5, where it should be noted, at this point, that the invention is not restricted to the embodiment variants specifically shown, but rather, instead, various combinations of the individual embodiment variants with one another are possible, and this variation possibility lies within the ability of a person skilled in this technical art, on the basis of the teaching for technical action provided by the present invention.

Furthermore, individual characteristics or combinations of characteristics of the different exemplary embodiments shown and described can represent independent inventive solutions or solutions according to the invention, in and of themselves.

The task underlying the independent inventive solutions can be derived from the description.

All information concerning value ranges in the present description are to be understood to mean that they include any and all partial ranges of them; for example, the information 1 to 10 should be understood to mean that all partial ranges, starting from the lower limit of 1 and including the upper limit of 10 are included, i.e. all partial ranges begin with a lower limit of 1 or more and end at an upper limit of 10 or less, e.g. 1 to 1.7 or 3.2 to 8.1 or 5.5 to 10.

Above all, the individual embodiments shown in FIG. 1; 2, 3; 4, 5, 6; 7, 8, 9; 10; 11, 12 can form the object of independent solutions according to the invention. The tasks and solutions according to the invention, in this regard, can be derived from the detailed description of these figures.

For the sake of good order, it should be pointed out, in conclusion, that for a better understanding of the structure of the closure system 5, this system or its components have been shown, in part, not to scale and/or enlarged and/or reduced in size.

REFERENCE SYMBOL LIST

1 zipper
2 slider
3 zipper pull tab
3*a* element
3*b* element
4 plate
5 closure system
6 closure piece
7 application element
8 base part
9 ring flange
10 ring
11 longitudinal axis
12 end

13 end
14 support apparatus
15 base plate
16 holding element
17 collar
18 opening
19 engagement apparatus
20 engagement element
21 engagement element
22 opening
23 inside surface
24 spring element The invention is:

1. A closure system for an article, the closure system comprising a zipper, a slider, as well as a zipper pull tab, in which, in the closed position of the zipper, the zipper pull tab, is passed, at Least in part, through a closure piece configured or disposed on the article, and, in this connection, the slider is held positioned on the article in this closed position of the zipper, wherein the closure comprises a base part comprising a hollow profile, which base part is connected with the article, and wherein, at least in the closed position of the zipper, at least one plate is disposed in the region of the closure piece, which plate comprises an application element, wherein the plate is attached to the base part of the closure piece, wherein the application element is disposed on a support apparatus and the application element is held on the base part by the support apparatus, and wherein at least one of the application element and the support apparatus is held positioned on the base part in at least one direction oriented in the axial direction of the base part, by interacting first and engagement elements of an engagement apparatus.

2. The closure system according to claim 1, wherein the plate is set onto the zipper pull tab of the zipper and held on the zipper pull tab by an engagement system.

3. The closure system according to claim 1, wherein the plate further comprise a support plate, to which the application element is attached.

4. The closure system according to claim 1, wherein at least the first engagement element is disposed or configured on an end of the base part, which end faces away from the slider.

5. The closure system according to claim 1, wherein the support apparatus comprises a base plate configured in disk shape, as well as at least one holding element connected with the base plate and extending in the perpendicular direction with reference to the base plate, and wherein the application element is held by the holding element.

6. The closure system according to claim 5, wherein at least the second engagement element of the engagement apparatus is formed by an end of the holding element of the support apparatus facing away from the slider.

7. The closure system according to claim 1, wherein at least the second engagement element of the engagement apparatus is disposed or configured on an inside surface of the base plate, which plate is configured in disk shape.

8. The closure system according to claim 1, wherein the closure piece, in addition to the base part, which is formed by an eye, furthermore comprises a ring connected with the base part, and the base part together with the ring form a grommet.

9. The closure system according to claim 1, wherein the plate and/or the application element and/or the support apparatus for the application element form a closing apparatus or locking apparatus in interaction with the closure piece as well as at least one locking element.

10. A closure system for an article, the closure system comprising a zipper, a slider, as well as a zipper pull tab, in which, in the closed position of the zipper, the zipper pull tab is passed, at least in part, through a closure piece configured or disposed on the article, and, in this connection, the slider is held positioned on the article in this closed position of the zipper, wherein the closure piece comprises a base part comprising a hollow profile, which base part is connected with the article, and wherein, at least in the closed position of the zipper, at least one plate is disposed in the region of the closure piece, which plate comprises an application element, wherein the plate is attached to the base part of the closure piece, wherein the application element is disposed on a support apparatus and the application element is held on the base part by the support apparatus, and wherein the application element and/or the support apparatus with the application element disposed on the support apparatus, has a setting force built up by a spring element, in the axial direction with reference to the base part, applied to the application element or the support apparatus on the side facing away from the slider.

* * * * *